United States Patent [19]

Ziegler

[11] Patent Number: 4,479,276

[45] Date of Patent: Oct. 30, 1984

[54] PROCESS FOR CONTINUOUS WET TREATMENT OF TEXTILE MATERIALS

[76] Inventor: Paul Ziegler, Franz/Höflerstrasse 2, I-39011 Lana (Bozen), Italy

[21] Appl. No.: 291,702

[22] Filed: Aug. 10, 1981

[51] Int. Cl.[3] ..... D06B 5/04

[52] U.S. Cl. ..... 8/152; 8/151; 8/158; 68/22 R; 68/62; 68/158; 68/175; 68/177; 68/181 R; 68/184

[58] Field of Search ..... 8/151, 152, 158; 68/181 R, 62, 158, 175, 177, 178, 179, 184, 22 R

[56] References Cited

U.S. PATENT DOCUMENTS

| | | | |
|---|---|---|---|
| 2,552,078 | 5/1951 | Williams | 68/175 X |
| 3,346,893 | 10/1967 | Carpenter | 68/181 R X |
| 3,349,580 | 10/1967 | Valls | 68/184 X |
| 4,182,141 | 1/1980 | Sando et al. | 68/177 X |

FOREIGN PATENT DOCUMENTS

| | | | |
|---|---|---|---|
| 2734768 | 2/1979 | Fed. Rep. of Germany | 68/181 R |
| 2935114 | 3/1981 | Fed. Rep. of Germany | 68/175 |
| 1353914 | 1/1964 | France | 68/178 |

*Primary Examiner*—Philip R. Coe
*Attorney, Agent, or Firm*—James Creighton Wray

[57] ABSTRACT

The disclosure relates to a process for continuous wet treatment of textile material in a container holding treatment liquid through which the material is being transported and is being penetrated by treatment liquid in a manner which is essentially vertical to its surface, and to devices for carrying out the process.

In a particularly appropriate device, textile material 16 is introduced from the top into treatment liquid 28, then is guided around a minimum of one part (52, 80, 81, 120) which is arranged in the lower region of inner container (30, 85, 87, 119) liquid permeable to a limited degree, along a wall, and is thereby deflected and transported in the direction of the upper edge of inner container (30, 85, 87, 119).

7 Claims, 6 Drawing Figures

PROCESS FOR CONTINUOUS WET TREATMENT OF TEXTILE MATERIALS

The invention relates to a process for continuous wet treatment of textile material, in a container of treatment liquid through which textile material is being transported.

Devices for carrying out such a process are described, for example, in patent DE-OS No. 25 31 528. This conventional arrangement comprises a vat filled with treatment liquid for the treatment of the textiles, over which vat there is arranged a textile material transport device consisting of a pipe through which there is a flow of treatment liquid and a deflecting roller located in front of the inlet opening of the pipe, which roller pulls the textile material from the vat. Moreover, a liquid-permeable conveyor belt ascending in feed direction of the textile material is arranged below the transport device at such height in the vat that in operation, the material is being transported above the level of the treatment liquid.

While this conventional device is very well suited for the dyeing of textiles, it has the distinct disadvantage of a relatively long treatment period for other treatment processes, e.g. washing of textiles.

It is the objective of the present invention to provide an improved process which reduces the time required for the wet treatment of textile materials.

This objective is achieved in the process previously described in that the treatment liquid penetrates or flows through the textile material in a direction which is essentially vertical to its surface. In this connection it is generally advantageous when the textile material is transported on a treatment path along a wall permeable to liquids in a limited manner, and that the side of the textile material facing away from the wall is subjected to a greater hydrostatic pressure than the side of the textile material facing the liquid permeable wall. The invention lends itself to wet treatment of continuous as well as flat textile materials, so-called piece goods.

The process of the invention not only offers a substantial reduction of treatment time but offers the advantage that essentially less treatment liquid is required to obtain the same end result, an advantage which is most significant to the practioner.

Due to the escalating water costs, this is a very important consideration, for instance, in connection with the washing of dyed textiles which conventionally require several washings after the dyeing process.

Further refinements of the invention, and particularly devices for carrying out the inventive process, are being described in the dependent claims and are further defined by way of drawings in connection with the examples. In these figures, which in part are depicted schematically for better understanding, corresponding parts are given the same reference numerals.

IN THE DRAWINGS

Figure 1:
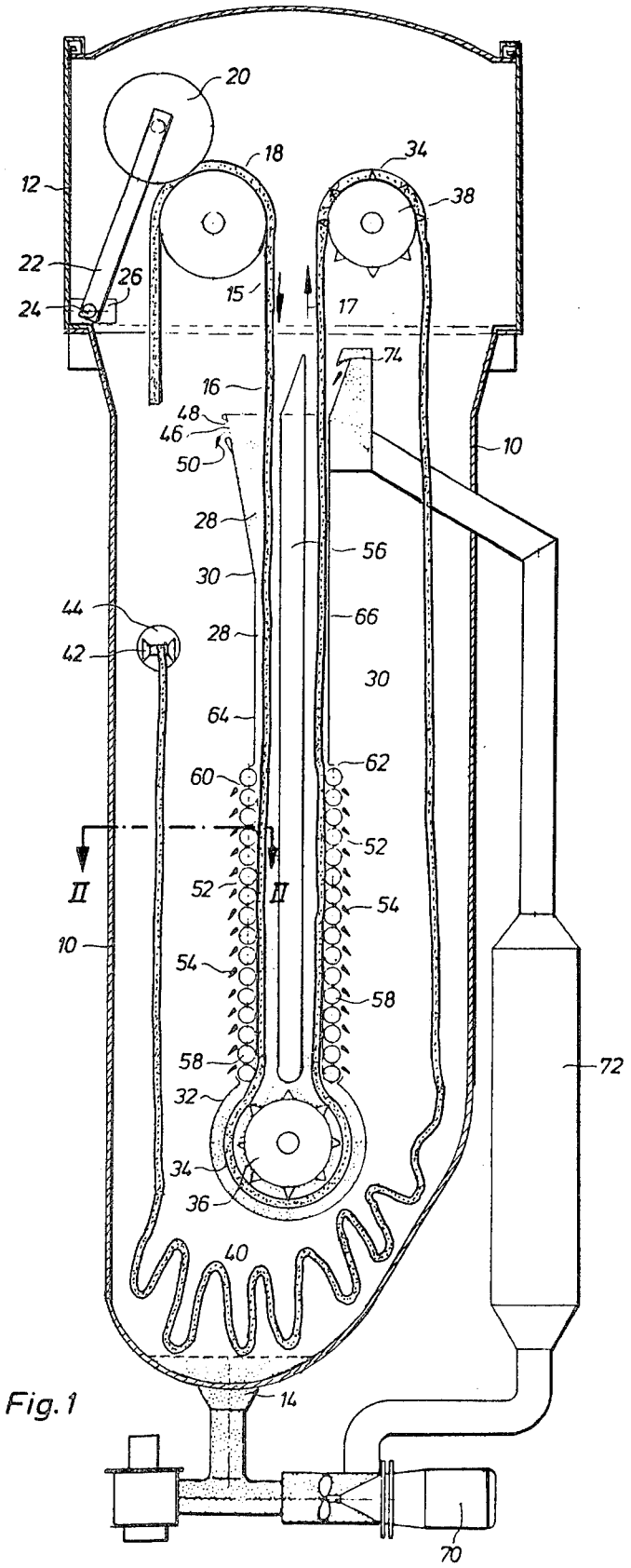
FIG. 1 is a sectional view of a device for carrying out the inventive process.

Outer container 10 sealed by cover 12 is shown in the device depicted in FIG. 1, in which the total assembly consists of several devices or compartments, similar in design, through which the treatment goods pass consecutively. In the lower portion, collection chamber 40 has discharge or suction funnel 14 for treatment liquid 28, also referred to as liquor or bath.

Figure 2:
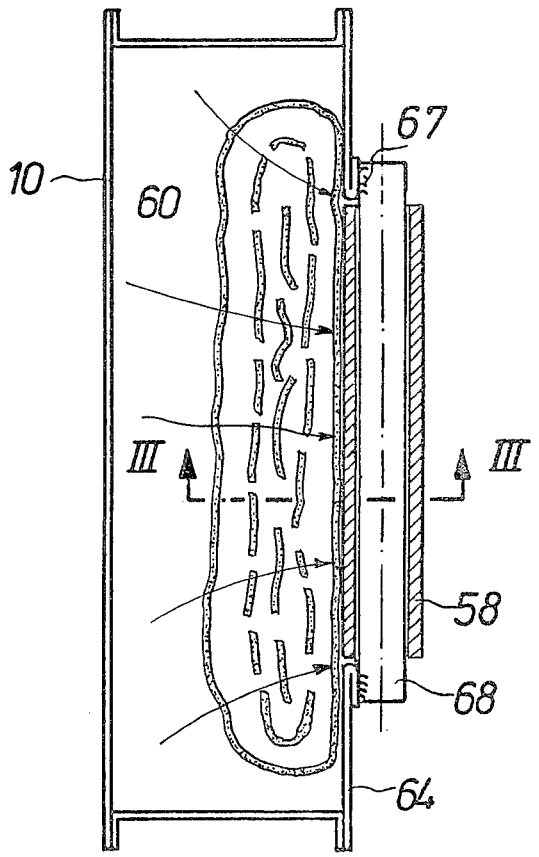
FIG. 2 is a sectional view along line II—II of FIG. 1, in the direction of the arrow, depicting structional detail of the arrangement and position of rollers, at a wall of the container through which the treatment material travels.

The width of the device according to FIG. 2 is indicated by the width of the continuous-type textile goods 16 to be washed or treated. These are introduced at an upper open portion of container 10 (not depicted) arriving from an adjacent compartment or device and initially travel via a feed roller 18 onto which they are pressed by the dead weight of idle press roller 20. To accomodate this purpose, press roller 20 is located at levers 22, which, for example, are rotatably mounted at 24 in frame part 26 of container 10. Subsequently, textile material 16, now moving downward in the direction of arrow 15, travels through the actual inner container 30 which contains liquor 28, and which is surrounded by outer container 10. Inner container 30 is curved in the lower part 32 and therein surrounds transport roller 36 having cam projections 34.

Textile material 16 then proceeds upwardly in liquor 28 in the direction of arrow 17 and is then deposited in lower collection chamber 40 by delivery rollers 38, also having cam projections 34. There it is again exposed to liquor 28 and ultimately reaches the next device or compartment via guide roller 42 through exit port 44, or in a final step, is guided to a drying device or such (not depicted). Rollers 36, 38 transporting textile material 16 advantageously are synchronously activated (not depicted).

As shown in FIG. 1, textile material 16 remains in chamber 40 for some time as it accumulates and collects here. Chamber 40 is still partly filled with liquor which reaches collection chamber 40 either from overflow 46 of inner container 30, by way of one or several openings 48 to outer container 10 (as indicated by arrow 50) or is collected in chamber 40 through arrangement 52 according to arrows 54, which arrangement will be later described.

in order to minimize the quantity of liquor 28 required, inner container 30 with its parallel running walls 64, 66 is kept narrow and additionally has liquid level displacement element 56 located between the parallel textile lengths which are moving in opposite directions, which element 56 practically divides container 30 into two compartments. Inner container 30 is divided into two compartments, through which textile material 16 runs, by the liquid level displacement element 56.

Figure 3:
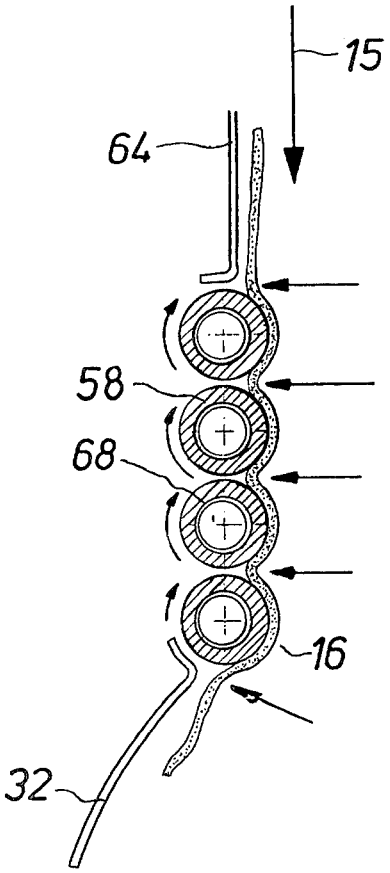
FIG. 3 is a sectional view of a structional detail of the arrangement of several rollers along line III—III of FIG. 2 in the direction of the arrow.

Roller arrangements 52 of which details are depicted in FIGS. 2 and 3 each have a number of rollers 58. They are freely rotatable on support rods 68 which are firmly welded at 67 to outer walls 64, 66, which have rectangular openings 60, 62, of inner container 30.

The space of inner container 30 containing liquor 28 is kept high in order to improve the degree of liquor penetration and obtain the maximum hydrodynamic pressure of liquor 28, against the textile material.

Hereby, liquor 28 presses against the textile material 16 which thus adapts to the shape of roller arrangement 52 and arrives between adjacent rollers 58. This is indicated in FIG. 3 and tends to encourage the formation of loops.

In this manner, liquid bath 28 conveniently presses vertically onto textile material 16 thus creating a liquor bath pressure which inherently effects a high degree of penetration of the textile length 16 by liquor 28. Textile length 16 travels through the device in an U-configuration with its U-shaped sides in the direction of arrows 15, 17.

Liquor 28, reaching rollers 58 through textile material 16, drains in accordance with arrows 54 and reaches, together with liquor 28 from overflow 46 in container 30, the lower chamber 40 of outer container 10, forming sump 19.

Liquor 28 is continuously suctioned from sump 19 via funnel 14 by pump 70. Liquor 28 passes through heating device 72, which maintains a certain liquor temperature, and ultimately reaches the upper portion of the right half of inner container 30, via feed device 74.

The excellent degree of penetration of textile material 16 by liquor 28 is not only due to the fact that liquor 28 exerts its pressure practically vertically to the surface of textile length 16, but can also be attributed to the fact that this occurs at two locations during the textile length's passage through the device, and can further be attributed to the fact that the path of liquor 28 in inner container 30 is partially in a direction which is opposite to the movement of textile length 16.

Figure 4:
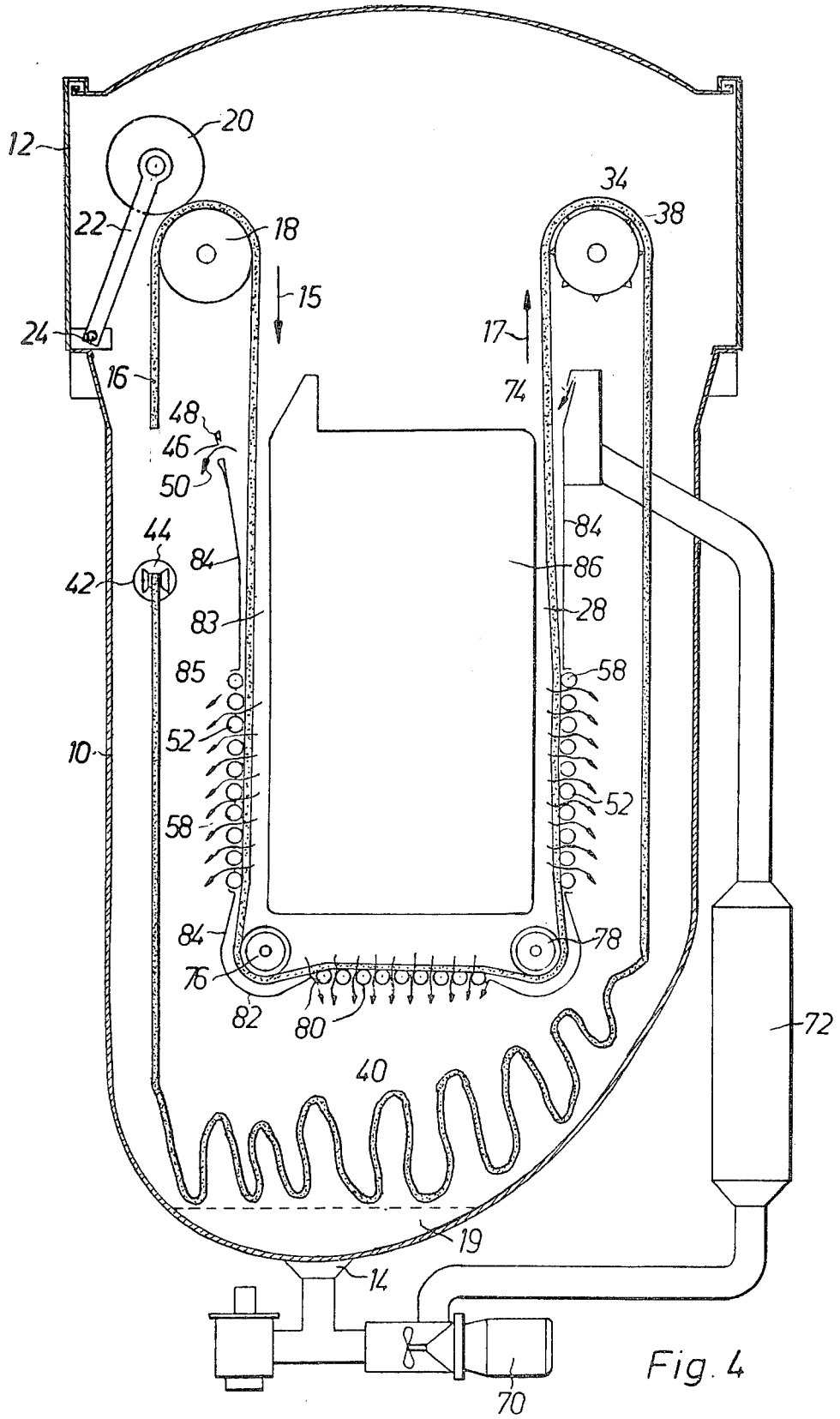
FIG. 4 is a sectional view of a variation of the device according to FIG. 1, with two deflector rollers in the lower region of the container holding the treatment liquid.

The variation of FIG. 4, which is similar to the device depicted in FIG. 1, uses deflection rollers 76, 78 in place of lower transport rollers 36, and in addition to roller arrangements 52, employs horizontal roller arrangement 80. Roller arrangements 52, 80 are located at the outer walls 84 and bottom wall 82 of inner container 85, which is filled with liquor 83. Their design is practically identical to those depicted in FIGS. 3 and 4. However, supporting rods 68 which rotatably support rollers 58 are firmly attached to the interior of walls 84 and to bottom 82 of inner vessel 85, e.g. by being welded thereto.

In this case, delivery roller 38 which also has cam projections 34, serves to drive textile material 16. As depicted in the example of FIG. 1, introduction of textile material 16 is via free running feed roller 18. Here too, inner container 85 has relatively wide liquid level displacement 86 which reduces the amount of liquor 28 required, and which divides the inner chamber containing liquor 28 into two small compartments. Liquid level displacement 86 is connected to the front sides of inner container 85, e.g. by being welded thereto. The remaining configuration of the device or compartment is practically identical to that of FIG. 1.

In operation, driven roller 38 draws off textile material 16 from feed roller 18. Thereby material 16 is pulled over deflection rollers 76, 78 and roller arrangements 52, 80 and also, due to hydrostatic liquor pressure, is pressed against roller arrangement 52, 80, as indicated in FIG. 4.

In the same manner as in the variation depicted in FIG. 1, pump 70 is in continuous operation. It forces liquor 28 into inner container 85 via heater 72 and assures an adequate liquor level.

Considerations of competition and cost effectiveness for such plants not only make it desirable to reduce the amount of liquor 28 per device or compartment but also indicate a need to reduce the dimensions of the devices or compartments without diminishing the stay time of textile goods in liquor 28. A variation of the invention achieving this objective is depicted in FIG. 5.

Figure 5:
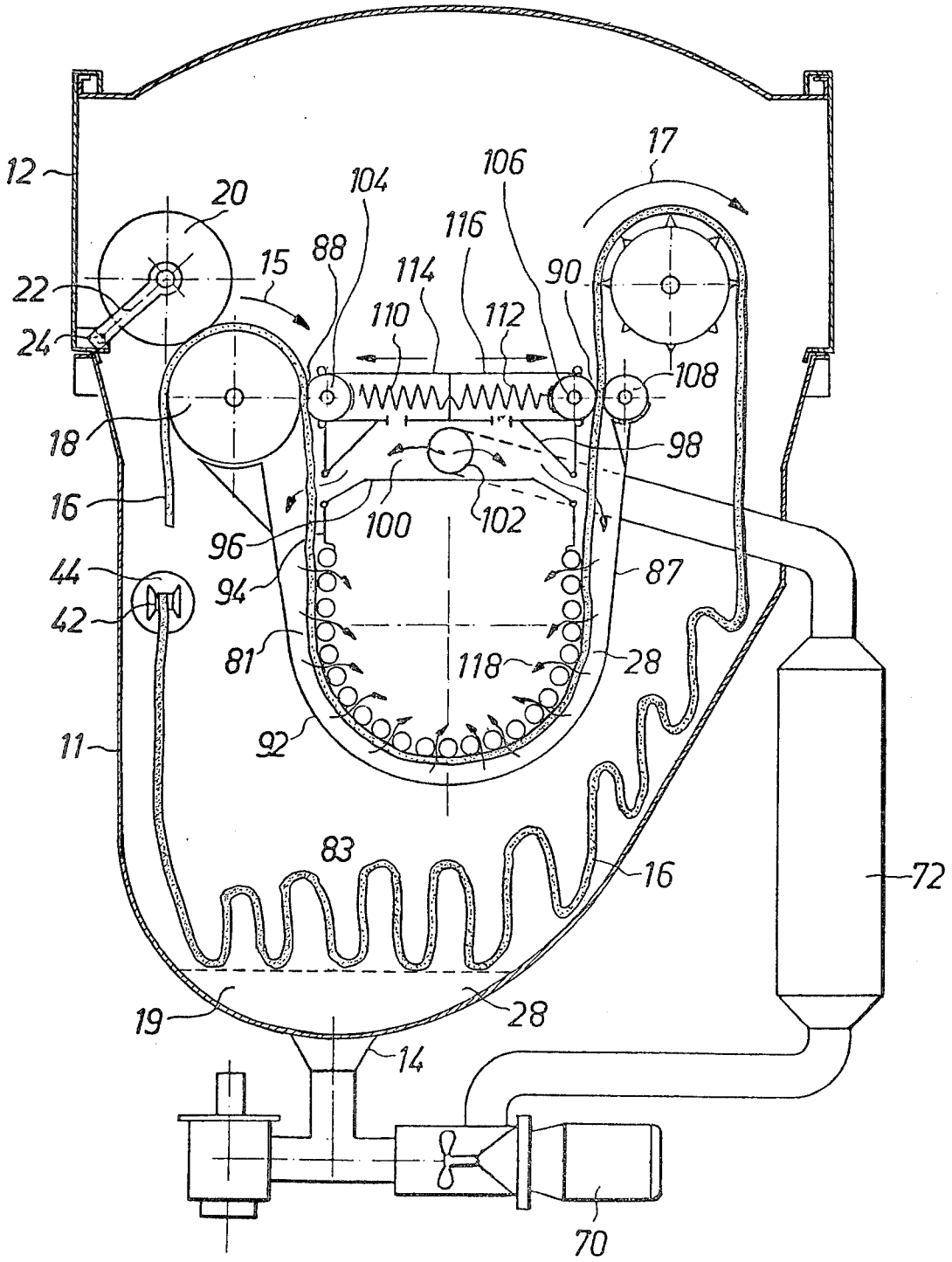
FIG. 5 is a further variation of the device of FIG. 1 for carrying out the inventive process, in which the working pressure of the treatment liquid is forcibly generated.

Contrary to the variations of FIGS. 1 and 4, which primarily utilize hydrostatic pressure of liquor 28 to obtain a practically vertical penetration of material 16, the device in FIG. 5 utilizes pressure which is being built-up by pump 70. To this end, there is provided inner container 87, surrounded by outer container 11 and having sealing elements at its inlet and outlet portions 88, 90, through which vessel the textile goods are running in an U-shaped path.

Inner container 87 consists of outer wall 92 and inner wall 94 supporting rods 68 with rollers 58, similar to the examples of FIGS. 2 and 3. It also comprises corresponding front walls (not depicted) whose lower portions form an overflow or drain for liquor 28 contained in container 87. The upper portion of inner container 87 consists of cover parts 96, 98 with loading chamber 100 into which liquor feed pipe 102 extends, from heater 72. Squeeze rollers 104, 106, 108 serve to seal the textile material 16 at inlet and outlet points 88, 90. Squeeze roller 108 is fixed, but rotatable, while squeeze rollers 104, 106, by means of springs 110, 112 press textile material 16 against feed roller 18 and fixed squeeze roller 108 and follow the power of textile material 16.

Flexible covers 114, 116 comprise the upper closing of container 87, so that only minute amounts of liquor 28, contained in container 87 under pressure, may escape to reach liquor sump 19 in collection chamber 83.

In operation, pump 70 extracts liquor 28, collected in sump 19, via funnel 14, and pushes it through heater 72 and pipe opening 102 into the inner chamber of inner container 87, formed by walls 92, 94, in which corresponding pressure is building up for forcing the liquor through the textile material. Delivery roller 38 thus pulls textile material 16 over a feed roller 18 and roller arrangements 81 which causes textile length 16 to lie against roller arrangements 81 so that liquor 28 presses practically vertically onto textile length 16, penetrating it and the overflow leaves container 87 in a manner indicated by arrows 118. From the lower front sides of container 87, liquor 28 reaches collection chamber 83 of outer container 11 where textile goods 16 accumulate for further wetting by liquor 28. Thereupon, the textiles reach the next device or drying device, respectively, via roller 42 and outlet 44.

The present invention affords realization of effective, practically vertically passage of liquor 28 through textile material 16 in a variety of ways.

Figure 6:
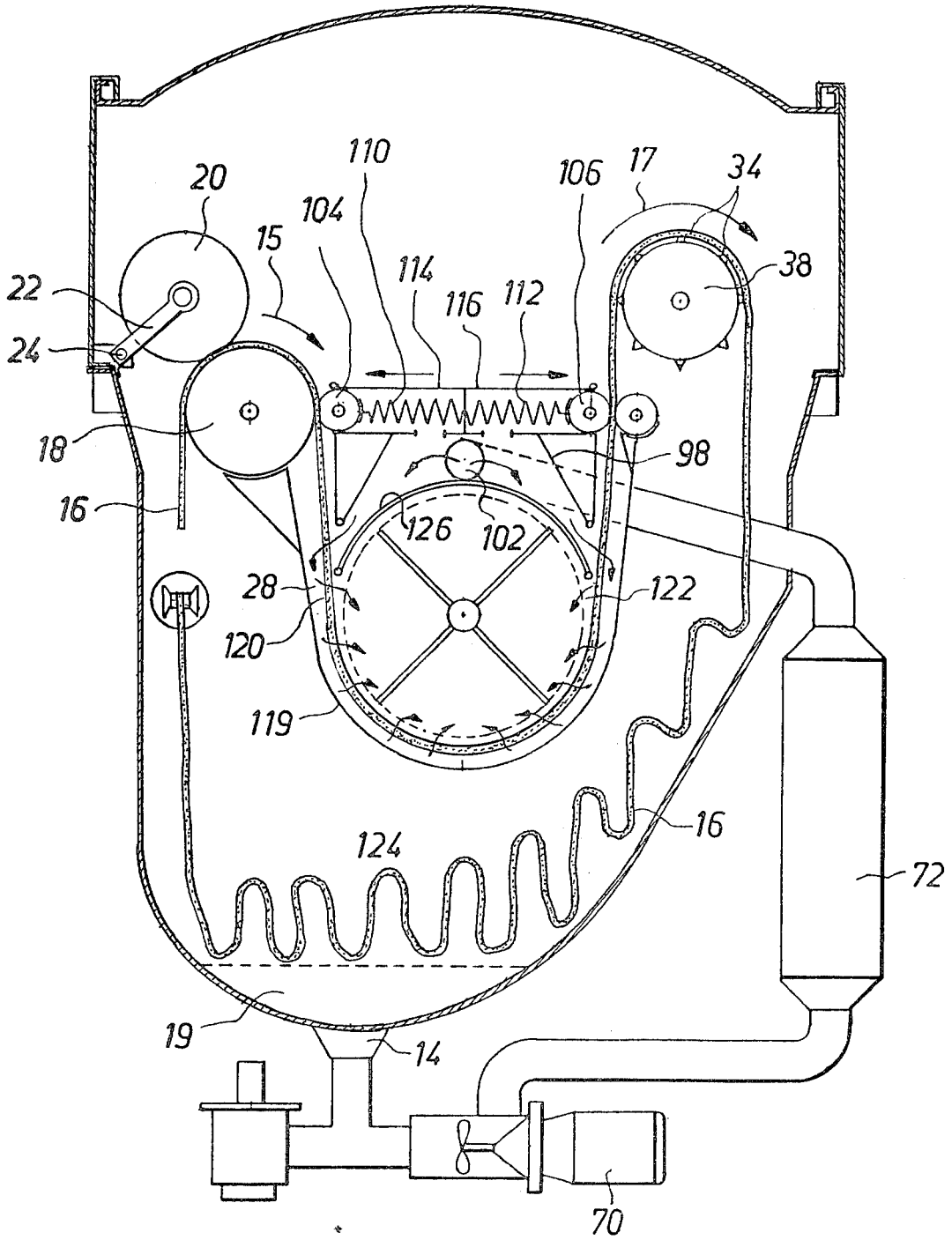
FIG. 6 is another variation of the arrangement according to FIG. 5, having a rotating drum.

Another variation of the invention is depicted in FIG. 6. Its design is similar to that of FIG. 5. In place of roller arrangements 81, however, a rotating drum 120 is employed whose outer jacket 121 has a multitude of small perforations 122 for entrance of liquor 28 travelling vertically through textile material 6. The arrangement can be such that drum 120 is carried along by the textile goods which are being transported through the device. Similar to the variations described in FIG. 5, pressure is built up by the liquor feed of pump 70 in inner container 119, located in outer container 11. This pressure forces liquor 28 to press practically vertically against textile material 16 which lies against the lower half of the surface of drum 120. The contact pressure of textile length 16 onto the surface of drum 120 is not merely caused by the pull of driven delivery roller 38, but also by the pressure exerted by liquor 28 in inner container 119.

Liquor 28 having been forced through textile length 16 and perforations 122 of the wall of drum 120 now returns to collection chamber 124 of outer container 11 by way of the open front sides of drum 120. Textile material 16 accumulates in the collection chamber in a manner indicated in the examples of FIGS. 1, 4 and 5.

Upper closure of inner container 119 here also is by covering 98 and squeeze rollers 104, 106 resiliently pressing at rollers 18 and 108, over textile length 16. The upper half of drum 120 is sealed off by a bottom portion 126 of the upper part of inner container 119, adapted to the curvature of the drum.

As indicated before, the entire assembly consists of a number of devices or compartments, respectively, described in FIGS. 1, 4, 5 and 6, through which textile material 16 passes.

Due to the advantageous utilization of the pressure being exerted by liquor 28 onto the surface of textile material 16, in a manner which is practically vertical, and as a result of its increased working pressure, it is possible to greatly reduce the amount of liquor in the individual devices or compartments, respectively and consequently reduce the quantity required in the total plant, while greatly increasing effectiveness or penetration of textile material 16 by liquor 28. Further cost reduction and a shorter treatment time are the result. Also, the above measures permit the general design of the plant to be on an essentially smaller scale, for a certain result of treatment, since the number of required devices or compartment, respectively, can be reduced for the predetermined end result and substantial savings can be realized with regard to space and overall costs.

I claim:

1. Process for continuous wet treatment of a textile material in a container of treatment liquid through which the textile material is being transported comprising passing textile material over a feed roller, passing the textile material from the feed roller vertically downward through an inner container, passing the textile material by openings in lower portions of the inner container and passing the textile material over parallel rollers adjacent the openings, passing the textile material around roller means within a bottom of the inner container and passing the textile material upward through the inner container, passing the textile material outward from the inner container and around a drive roller and driving the drive roller and the textile material, passing the textile material downward from the drive roller through an outer container surrounding the inner container, accumulating the textile material in a bottom of the outer container and passing the textile material upward through the outer container and outward through an opening in the outer container, flowing treatment liquid from the inner container through the textile material and through openings in lower portions of the inner container and adjacent parallel rollers into the outer container and over the textile material accumulated in the bottom of the outer container, and flowing treatment liquid from an overflow in an outer wall of the inner container near the feed roller into the outer container.

2. The process of claim 1 wherein the passing of the textile material adjacent parallel rollers comprises passing a textile material downward over plural parallel rollers in a first set of rollers and then upward over parallel rollers in a second set of rollers.

3. The process of claim 2 wherein the passing of the textile material over parallel rollers further comprises passing the textile material over a bottom group of parallel rollers and wherein the passing of the textile material around roller means in the bottom of the inner tank comprises passing the textile material over first and second spaced rollers between which are located the bottom set of parallel rollers.

4. The apparatus of claim 3 wherein the flowing treatment liquid into the inner container comprises flowing treatment liquid into the inner container near the drive roller.

5. The process of claim 1 wherein the flowing of treatment liquid into the inner container comprises flowing of treatment liquid under pressure into the inner container and further comprising sealing the inner container with rollers on opposite sides of the textile material.

6. The process of claim 5 wherein the sealing of the inner container comprises pressing a squeeze roller against the textile material as it passes around the feed roller and passing the textile material through opposite squeeze rollers as the textile material is passed out of the inner container.

7. The process of claim 6 further comprising withdrawing liquid from the outer container, pumping the liquid to an increased pressure and flowing the liquid under increased pressure into the inner container against a pressure in the inner container.

* * * * *